US005383635A

United States Patent [19]

Barone

[11] Patent Number: 5,383,635

[45] **Date of Patent: * Jan. 24, 1995**

[54] NO-SEW FABRIC WRAP TABLES

[76] Inventor: Dana Barone, 1155 Walter Blvd., Manahawkin, N.J. 08050

[ * ] Notice: The portion of the term of this patent subsequent to Oct. 6, 2009 has been disclaimed.

[21] Appl. No.: 116,853

[22] Filed: Sep. 7, 1993

[51] Int. Cl.[6] ..... F16M 11/20

[52] U.S. Cl. ..... 248/188.1; 108/150

[58] Field of Search ..... 160/383, 382, 38, 19, 160/391, 405, 327, 354, 368.1; 248/188.1, 188.8, 345.1, 677; 108/150

[56] References Cited

U.S. PATENT DOCUMENTS

| | | | |
|---|---|---|---|
| 3,219,301 | 11/1965 | Robinson et al. | 248/188.1 |
| 3,494,308 | 2/1970 | Perrin | 105/150 |
| 4,201,359 | 5/1980 | Baslow | 248/345.1 |
| 4,754,943 | 7/1988 | Froutzis | 248/188.1 |
| 4,760,802 | 8/1988 | Leong | 248/188.1 X |
| 5,033,525 | 7/1991 | Paeselt | 160/39 |
| 5,152,331 | 10/1992 | Barone | 160/38 |

*Primary Examiner*—David M. Purol
*Attorney, Agent, or Firm*—Charles I. Brodsky

[57] ABSTRACT

The no-sew fabric wrap tables of the invention comprise a pair of forms of semi-soft foam which are covered by fabric through a wrap and tuck process. Each form incorporates a straight slit cut into an exterior surface running along its entire length, and each form additionally incorporates a cross-shaped slot running through its center, also along its entire length. The fabric employed is wrapped around each form, cut to the length desired, with its ends fitted into the straight slit. The sides of the fabric are then tucked into each cross-shaped slot. Once so completed, the forms are slid over the angled edges of a metal stem which is joined to the base and cap of the table being made. Each fabric wrapped form then covers half the stem, being joined together side by side, and providing a seamless finish as the included slits become undetectable when they meet side-by-side.

17 Claims, 4 Drawing Sheets

NO-SEW FABRIC WRAP TABLES

FIELD OF THE INVENTION

This invention relates to styles for room decoration and, more particularly, to treatments for custom matching and coordinating tables and pedestals to match upholstery, window treatments, wallpapers, mirror frames and other decorating accessories.

BACKGROUND OF THE INVENTION

My U.S. Pat. No. 5,152,331, issued Oct. 6, 1992, describes a no-sew window treatment in which a form of semisoft foam is covered by fabric through a wrap and tuck process. In particular, the form incorporated a straight slit cut into an exterior surface running along its entire length, and additionally incorporated a cross-shaped slot running through its center, also along its entire length. As there described, the fabric employed was wrapped around the form, cut to the length desired, and with its ends then fitted into the straight slit. With the sides of the fabric then tucked into the cross-shaped slot, the result was to provide a form which held the fabric in place, and one which was easy to install, cover and assemble, and without the need for any sewing to give a customized look.

As will be seen from the description that follows, this invention is directed to the design of tables, pedestals and accessories which can be custom matched and coordinated with such window treatments, using the same no-sew concept of my earlier patent.

SUMMARY OF THE INVENTION

As will become clear from the description that follows, no-sew fabric wrap tables and pedestals are formed by sliding pairs of these forms onto a stem which is joined to a base support and cover support in forming the arrangement. More specifically, and as will become clear, after the two foam forms are wrapped, they are slid over angled edges of the stem from opposite sides to come together as a pair, with each covering half the stem in being formed together side-by-side. As will be appreciated by those skilled in the art, the angled edges serve to hold the forms in position, with the end result being a joining of the forms in a seamless finish as the slits (where the fabrics are tucked) become undetectable once the forms meet side-by-side. As will be understood, such stem couples to the base and cover in adding to the structural integrity of the finished table or pedestal, and relieves the foam forms from having to support the weight of the table top, the pedestal top, or any lamp, vase, etc. which may be placed thereon. As will be understood, different combinations and heights can be ascribed to the fabric covered foams, and different arrangements of bases and covers assigned in creating different styles of tables or pedestals—whether they be employed as coffee tables, end tables, console tables, night tables, etc. In any event, the fabrics selected can be chosen so as to match with other upholstery in a room, with window treatments (such as that described in U.S. Pat. No. 5,152,331), wallpapers, mirror and picture frames, etc.

BRIEF DESCRIPTION OF THE DRAWINGS

These and other features of the present invention will be more clearly understood from a consideration of the following description, taken in connection with the accompanying drawings, in which.

Figure 9:
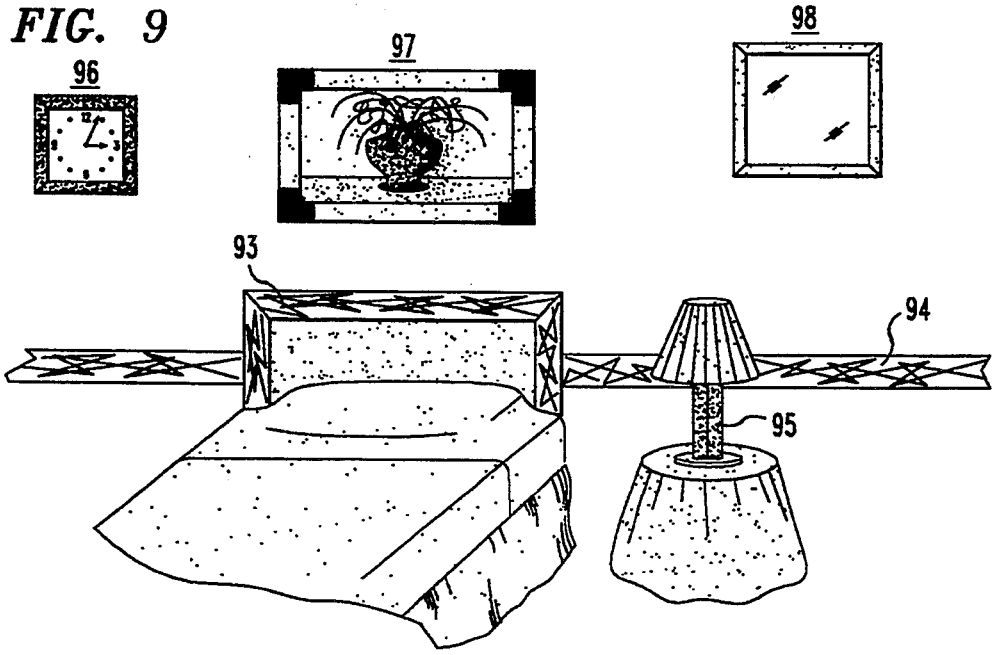

FIGS. *7a* and *7b* are helpful in an understanding of another aspect of the invention, as it might be utilized in the decoration of picture frames and mirror frames in accordance with the invention;

FIGS. *8a–8d* show different types of corner finishes that can be employed with the arrangements of FIGS. *7a* and *7b;* and FIG. 9 illustrates a portion of a room decoration showing how the no-sew fabric wrap feature of the invention can be utilized in coordinating various items of room decoration.

DETAILED DESCRIPTION OF THE DRAWINGS

Figure 1:
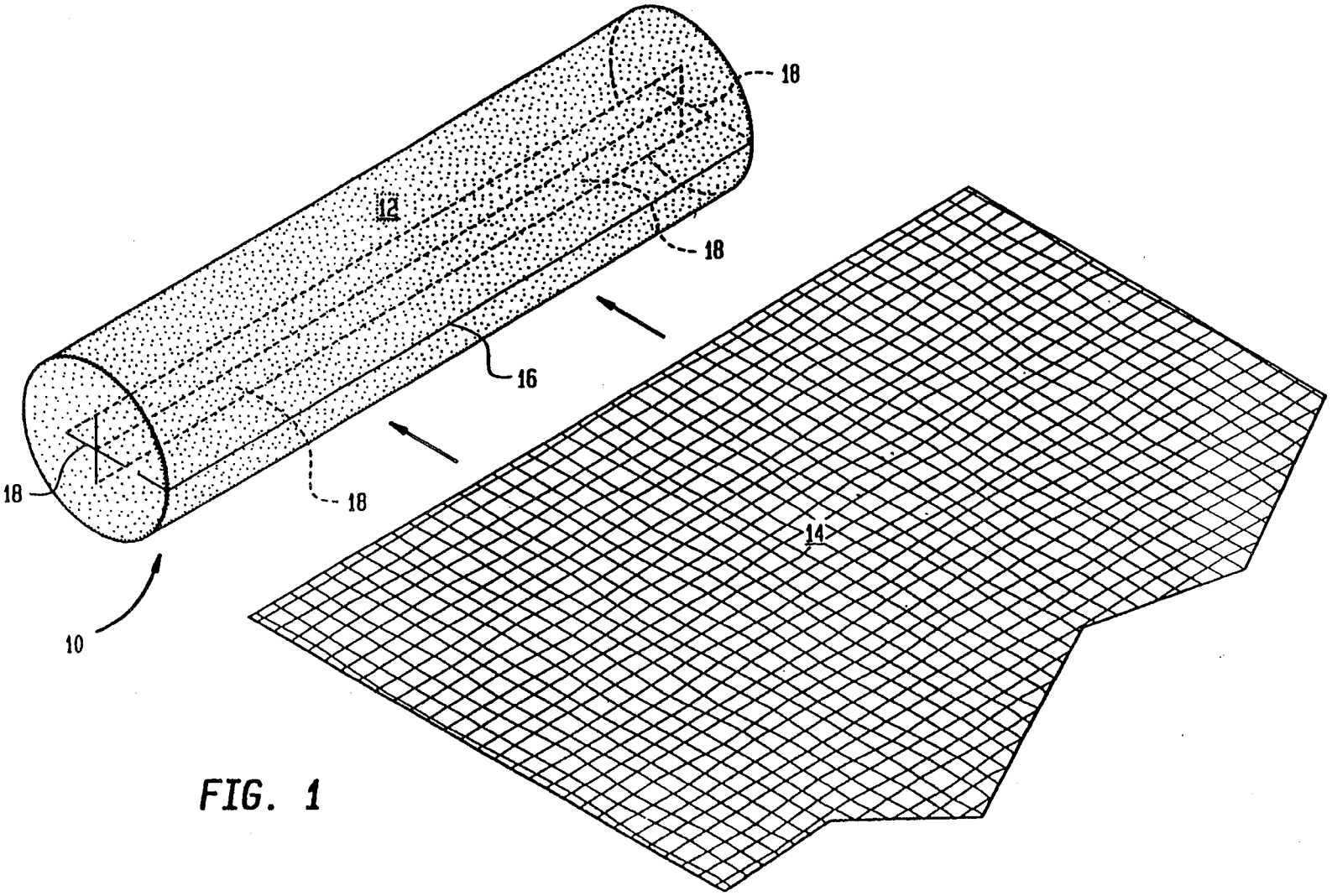
FIG. 1 is a perspective view of a semi-soft foam of predetermined shape and dimension, helpful in an understanding of the invention.

In FIG. 1, reference numeral 10 identifies a form of semi-soft foam 12 of predetermined shape and dimension, cut to any length desired. As described in my aforementioned United States patent, such form may be of circular, semi-circular, square, or rectangular cross-section around which a fabric 14 is to be wrapped and tucked. To facilitate this, a straight-slit 16 is cut into an exterior surface of the foam 12, running along its entire length. Also shown is a slot 18 which also runs along the entire length of the foam along its central axis, and of an "X" or cross-shape in a preferred embodiment. In accordance with the invention there described, the fabric 14 is cut to size, and wrapped around the foam 12 such that its opposite ends are available to be inserted into the straight slit 16, while the opposite sides of the fabric 14 are available to be tucked into the cross-shaped slot 18 running through the foam center. While this can easily be done by hand, the use of a "stake" or similar such tool can be utilized to more easily tuck the sides into the slot 18, and to then rotate the stake in tightening the fabric 14 against the exterior surface of the foam 12. By employing a semi-soft foam—of polyethylene, for example, and of a polyethylene employed in packaging and industrial use, in particular—the fabric 14 will be held in place, flatly secured against the shape of the foam 12, and held there especially when the slit 16 is selected of an opening to accept the opposing ends of the fabric in a close fit. Such polyethylene may have a density of between 1.5 and 4.5 pounds per cubic foot, and able to withstand a compressive force of between 3 and 19 pounds per square inch. As there described, such form requires no sewing to hold the fabric in place, can be cut to measure and can be easily disassembled to change fabric coverings as desired at later times.

Although my U.S. Pat. No. 5,152,331 was particularly described with respect to establishing treatment styles for creating valance, cornice and "topper" window arrangements simply and inexpensively, I have found that the advantages and benefits set forth there can equally be had in designing tables, pedestals, picture and mirror frames, and other furnishing accessories.

Figure 2:
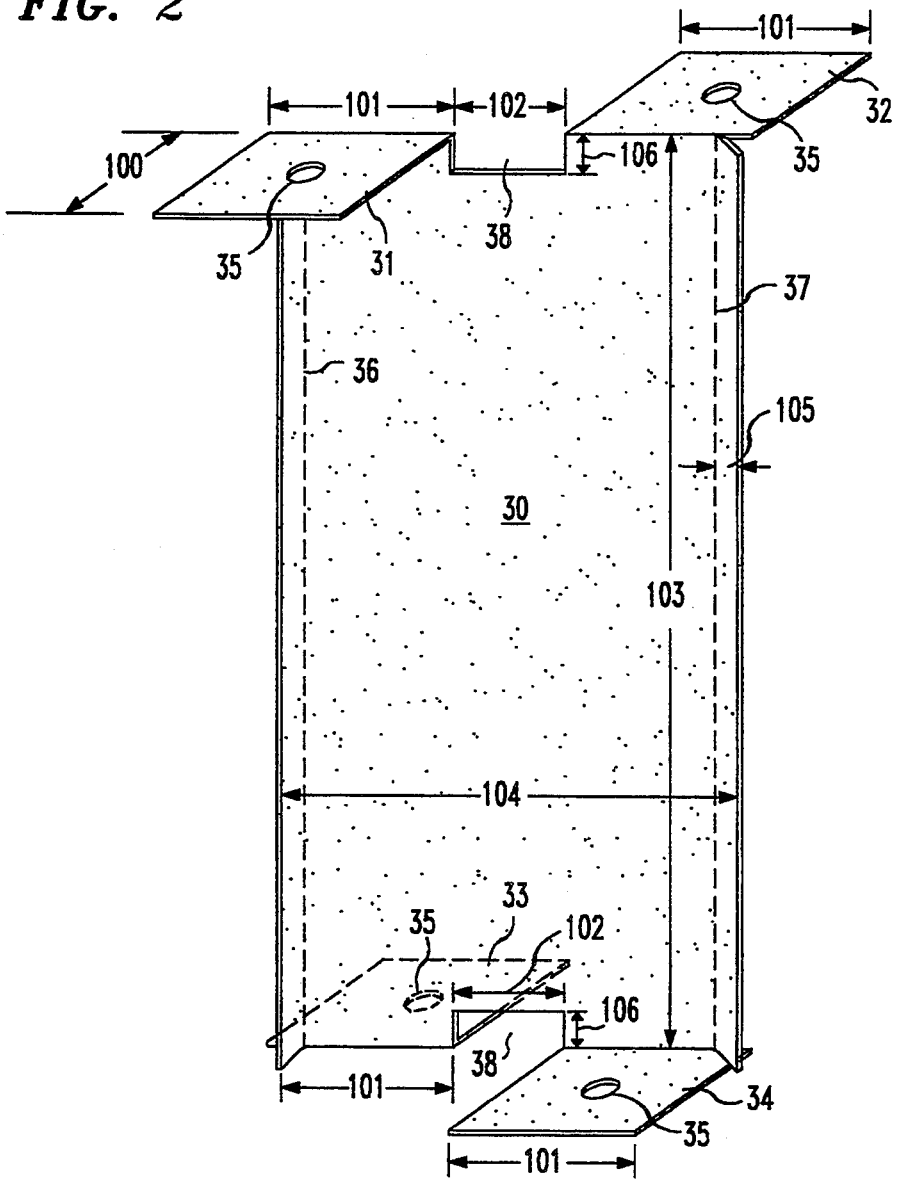
FIG. 2 illustrates a metal stem constructed according to a preferred embodiment of the invention, in accepting pairs of foams of the type illustrated in FIG. 1.

In FIG. 2 a planar section stem—preferably of metal for providing support—is shown at 30, and incorporating dual pairs of planar sections 31, 32 and 33, 34 in oppositely disposed, facing relationship. More specifically, and as will be seen, the sections 31, 32 at the "top" of the stem 30 face in opposite directions, as do the sections 33, 34 at the "bottom" of the stem 30. In similar manner, the left-most section 31 at the "top" of the stem 30 faces in a direction opposite to the left-most section 33 at the "bottom" of the stem 30, while the right-most section 32 at the "top" of the stem 30 is similarly aligned in opposite facing relationship to the right-most section 34 at the "bottom" of the stem 30. Each such section 31, 32, 33 and 34, furthermore, is provided with an aperture 35 to receive a fastener in a manner to be described below. As will be appreciated from FIG. 2, each section 31, 32, 33, 34, may be formed by a "bending" at the "top" or "bottom" ends of the stem 30, so as to essentially form "tabs" at a substantially 90° angle with respect to the plane of the stem 30. To assist in securing the metal stem 30 to a base and cover in fabricating tables, pedestals, etc. according to the invention, the holes or apertures 35 are dimensioned to accept #6 wood screws. To couple to secure the fabric wrapped forms of FIG. 1 in place, the stem 30 will be understood to be inwardly bent at its "left" and "right" edges at approximately a 135° angle, measured inwardly with respect to the plane of the paper (i.e. rotating the "left-edge" 45° clockwise and the "right-edge" 45° counter-clockwise behind the plane of the drawing. As so "bent", the end of the left-side of the stem 30 appears at 36, and the right-side end appears at 37. As will be noted, a pair of cut-outs 38 respectively separate the bent—or folded-over—sections 31, 32 and 53, 34.

While applicant does not wish to be limited to any particular set of values, the following have proved useful in a construction of the invention according to the preferred embodiment:

Dimension 100 . . . 1½ inches
Dimension 101 . . . 2 9/16 inches
Dimension 102 . . . 1¼ inches
Dimension 103 . . . 11 inches
Dimension 104 . . . 6¼ inches
Dimension 105 . . . 3/16 inches
Dimension 106 . . . 1 inch Such metal stem 30 may be fabricated of 16 gauge steel, with a baked enamel paint finish, colored off-white.

Figure 3:
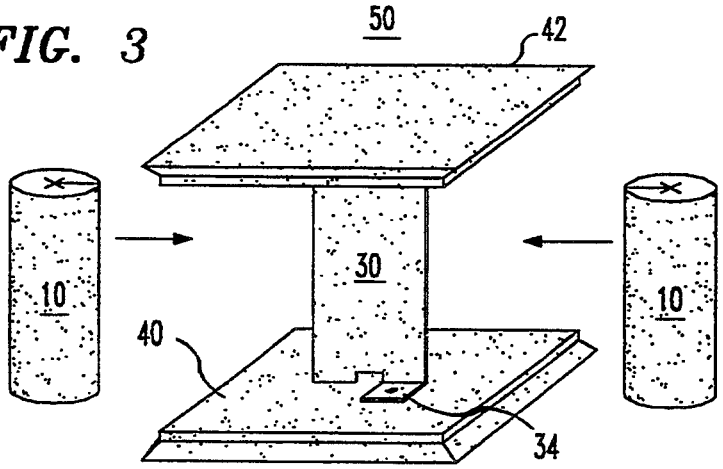
FIG. 3 is an illustration helpful in an understanding of the manner of sliding the foam forms onto the stem of FIG. 2.

FIG. 3 illustrates the manner by which the fabric wrapped form 10 of FIG. 1 is coupled with the stem 30 of FIG. 2 in forming an occasional table. In such an arrangement, a base 40 is shown secured to the stem 30 by an appropriate screw (not shown) passing through the hole or aperture 35 in the right-most planar section 34 at the "bottom" of the stem, and by a comparable screw passing through the aperture 35 in the planar section 33 at the left side of the "bottom" of the stem 30 (see FIG. 2). In like manner, a cover 42 is shown, understood to be secured to the right and left-most planar sections 32 and 31 respectively at the "top" of the stem 30, and similarly secured so as to provide the construction identified by reference numeral 50 in FIG. 3. As there illustrated, two forms 10 are then slid on the left and right edges of the stem 30, and to be there held in place along the "bent" ends 36, 37 of the stem. In a preferred embodiment of the invention, the dimensions selected for the stem 30 and its parts were chosen so as to afford a close-fit with the slit 16 when the forms 10 were inserted completely onto the stem 30. To provide a further support, a pair of screws might be inserted through the bottom of the base 40, up into the forms 10.

Figure 4:
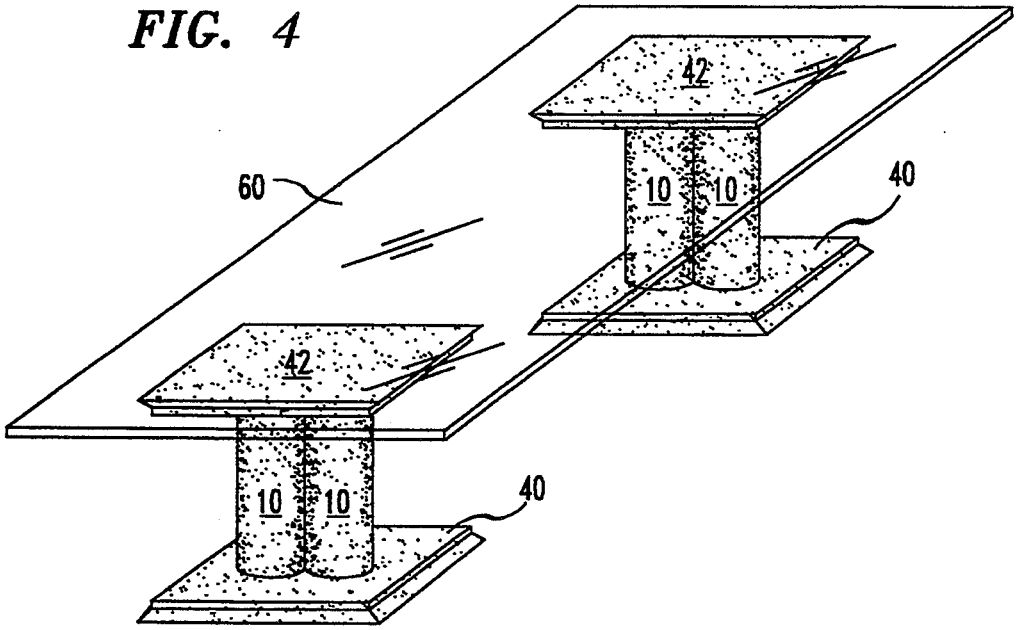
FIGS. 4–6 illustrate occasional tables and pedestals which may be fabricated according to the teachings of the invention.
Figure 5:
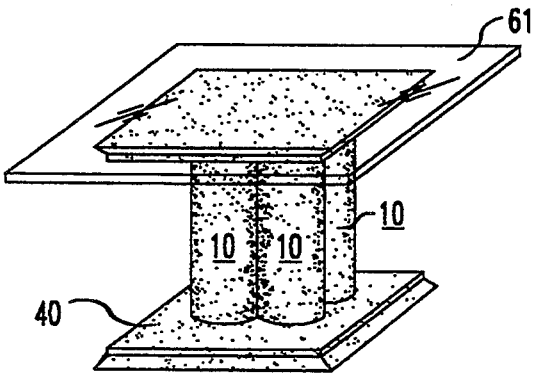
Figure 6:
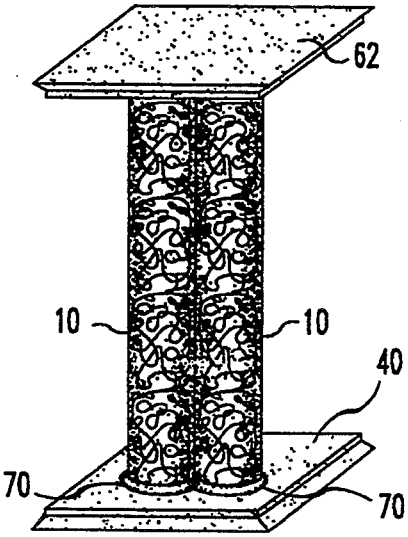

FIGS. 4, 5 and 6 then illustrate a rectangular coffee table, a square coffee table and a pedestal constructed in the manner shown in FIG. 3, and embodying the invention. In particular, FIG. 4 shows two sets of the forms 10 on a pair of stems 32, with a pair of bases 40, a pair of covers 42 and an overlying glass top 60. In FIG. 5, on the other hand, the four forms 10 of FIG. 4 are secured—still inserted upon a pair of stems 30 as in FIG. 4—, but arranged to be on a single base 40, with a single cover 42, forming a "square" version of the rectangular coffee table of FIG. 4, with the glass top indicated at 61. In FIG. 6, furthermore, only a pair of forms 10 are shown about a single stem, but of a greater length in forming a pedestal.

As will be evident from the arrangements of FIGS. 4–6, a seamless finish is seen by the naked eye as the pair (or pairs) of slits meet side by side when the form is fully in place, to provide an undetectable, seamless finish. As will be appreciated, the metal stem joining the base and cover together add to the structural integrity of the fabric-wrapped foam, relieving it of any responsibility from having to support the weight of the cover and/or cap atop it, and any lamp, vase, or sculpture that may rest on top of that.

(The pedestal of FIG. 6 also shows the use of a decorative collar 70 at the lower-most end of the form 10, to give a finished look to the construction, with the collar 70 being of a fabric or metallized construction. A second such pair would preferably also be incorporated where the form 10 meets with the cover in completing the design, with the collar arranged to enwrap the form as shown, but being tucked in at the slit 16 so as to be there held in place.)

As will be appreciated, the composition and decorative aspects of the base, the cover and cap of FIGS. 3–6 may be selected of wood, formica, ceramic, veneer or a metal finish, it will be appreciated that there function continues to give to the occasional table design both a structural strength and a support. At the same time, incorporating a "broad" base and top add a degree of "sturdiness" to the design in preventing the finished furnishing from toppling over.

In accordance with the no-sew concept forms of the invention, an extended leeway exists to utilize the forms in other manners of decoration. For example, FIGS. *7a* and *7b* show a mirror 80 provided with four longitudinally running strips 81 secured at its back, with the strips being inwardly bent (or folded over) at 45° angles to form a lip 82 of some 3/16" depth. Such lips 82 are arranged to slide within the straight-slit 16 of each form 10 employed, preferably in a close fit, to essentially border the mirror with the fabric foams, in coordinating the mirror with the types of occasional tables shown in FIGS. 4–6. The back of the mirror may be finished and arranged in any appropriate manner so as to afford its being decoratively hung. In this arrangement, as with the occasional tables, the foam form 10 slides snugly onto the strip 81, overlying the flat surface of the mirror in giving to it a fabric-covered look.

Figure 8A:
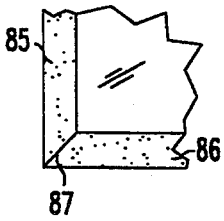
Figure 8B:
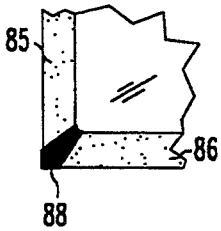
Figure 8C:
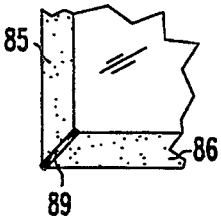
Figure 8D:
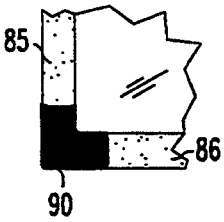

FIGS. *8a*–*8d* illustrate different ways of finishing-off the foam wrapped forms that might go on the mirror 80 of FIGS. *7a* and *7b*, or similarly onto picture frames or clock frames, for that matter. In FIG. *8a*, specifically, two forms 85, 86 are shown, with their edges mitered as at 87 so as to butt together. FIG. 8*b*, on the other hand, shows a fabric accent 88 where the edges of the forms 85, 86 adjoin, in the nature of a rectangular strip of fabric gathered and tucked into the slit of one of the forms, and then wrapped around it and tucked into the slit of the other form. FIG. 8*c* shows the use of a metallic accent 89, intercoupled around the forms 85, 86, and tucked into each of their respective slits in the manner of FIG. 8*b*. In FIG. 8*d*, on the other hand, a corner elbow 90 is utilized with the forms 85, 86, for use where the forms 85, 86 employ straight cuts, and are butted up against one another. (As will be apparent, the corner elbow 90 may be accented by fabric or a metallized composition, to be matching or contrasting with the fabric covering the two forms.) In each manner, four lengths of such foam forms are slid over the sides of the mirror or framing, to finish off their edges in creating an upholstered look to the design.

In like manner, the teachings of the invention operate equally as well in framing headboards of beds and even chair rail moldings with the fabric form constructions. Thus, and in FIG. 9, fabric forms may be incorporated along with the headboard 93, the chair rail 94, the lamp 95, the clock 96, the picture frame 97, as well as the mirror 98. Each unit there is arranged to slide within the slit 16 of the foam fabric form 10 in a close fit, to be held thereby.

Such features permit a person to custom match and coordinate their furnishings simply by selecting the foam-form fabrics to match the other upholstery, window treatments, wallpapers, etc. in a room. Lamps, moldings, headboards, room partitions, candlesticks and other furniture accessories can correspondingly be designed and custom coordinated by sliding the no-sew fabric covered foam forms of FIG. 1 onto them, as long as a flat surface is afforded to fit within the slit 16. Various shapes for the fabric forms can be utilized—circular, semi-circular, square, rectangular, etc.—with or without other decorative balls, joints, offsets, of any configuration in finishing off the decorative appearances available with the no-sew fabric designs.

Figure 7A:
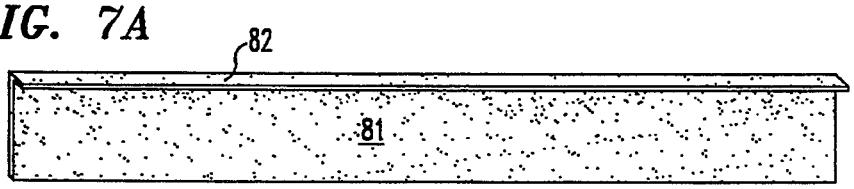
Figure 7B:
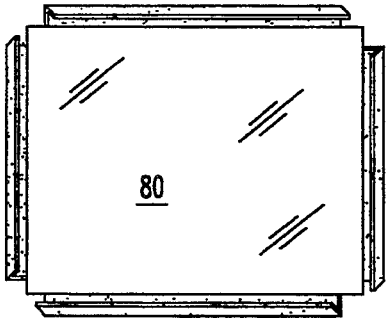

While there have been described what are considered to be preferred embodiments of the present invention, it will be readily appreciated that modifications can be made by those skilled in the art without departing from the scope of the teachings herein. For example, the four longitudinal strips 81 of FIGS. 7*a* and 7*b* could, where desired, be eliminated in those instances where the dimension of the slits 16 of the forms 10 are such that almost a press-fit could be had with the edges of the mirror—then only the use of "pins" would be needed at the abutting joints to hold the foam forms in place. For at least such reason, therefore, resort should be had to the claims appended hereto for a true understanding of the scope of the invention.

I claim:

1. Apparatus comprising:
- a first elongated semi-soft foam of predetermined shape and dimension;
- a straight slit in an exterior surface of said first foam running along the length of said first foam;
- a slot at least at one end of said first foam;
- a fabric covering wrapped around said first foam, having opposing ends fitted into said slit and opposing sides tucked into said slot;
- a second elongated semi-soft foam of predetermined shape and dimension;
- a straight slit in an exterior surface of said second foam running along the length of said second foam;
- a slot at least at one end of said second foam;
- a fabric covering wrapped around said second foam, having opposing ends fitted into said slit and opposing sides tucked into said slot; and
- means coupled between said slits of said first and second foams for joining said first and second foams together.

2. The apparatus of claim 1 wherein said slits of said first and second foams are of an opening to accept said opposing ends of said fabrics in close fit.

3. The apparatus of claim 2 wherein said slits of said first and second foams are also of an opening to accept said coupling means in close fit.

4. The apparatus of claim 3 wherein there is additionally included a planar section and means for connecting said coupling means to said planar section in providing a base support for said first and second foams.

5. The apparatus of claim 3 wherein there is additionally included first and second planar sections, and means for connecting said coupling means to said first and second planar sections in providing a base section and cover section for supporting said first and second foams.

6. The apparatus of claim 5 wherein said connecting means incorporates dual pairs of additional planar sections cooperating with said coupling means in providing said base section and cover section for supporting said first and second foams.

7. The apparatus of claim 5 wherein said connecting means incorporates dual pairs of additional planar sections cooperating with said coupling means in providing said base section and cover section for supporting said first and second foams, with the orientation of one of said pairs of additional planar sections being oppositely disposed with respect to the orientation of the other of said pair of additional planar sections.

8. The apparatus of claim 7 wherein each one of said pair of additional planar sections extends in opposite orientation with respect to the other of said pair of additional planar sections.

9. The apparatus of claim 3 wherein said slots of said first and second foams run substantially along the entire length of said foams.

10. The apparatus of claim 9 wherein said slots are positioned at least at each end of said respective foams along a central axis thereof.

11. The apparatus of claim 10 wherein the shape of each said foam is one of square, rectangular, circular and semi-circular cross-section.

12. The apparatus of claim 11 wherein each said semi-soft foam is composed of polyethylene.

13. The apparatus of claim 3 wherein said coupling means further includes an angular extension oriented to retain said foams thereon.

14. Apparatus comprising:
- a first elongated semi-soft foam of predetermined shape and dimension;
- a straight slit in an exterior surface of said first foam running along the length of said first foam;
- a slot at least at one end of said first foam;
- a fabric covering wrapped around said first foam, having opposing ends fitted into said slit and opposing sides tucked into said slot;
- a second elongated semi-soft foam of predetermined shape and dimension;

a straight slit in an exterior surface of said second foam running along the length of said second foam;

a slot at least at one end of said second foam;

a fabric covering wrapped around said second foam, having opposing ends fitted into said slit and opposing sides tucked into said slot; and means for coupling said first and second foams at a predetermined angle with respect to one another.

15. The apparatus of claim 14 wherein said means couples said first and second foams at a 90° angle with respect to one another.

16. The apparatus of claim 15 wherein said means includes a miter of respective ends of said foams to oppositely oriented 45° angles.

17. Apparatus comprising:

a first elongated semi-soft foam of predetermined shape and dimension;

a straight slit in an exterior surface of said first foam running along the length of said first foam;

a slot at least at one end of said first foam;

a fabric covering wrapped around said first foam, having opposing ends fitted into said slit and opposing sides tucked into said slot;

a second elongated semi-soft foam of predetermined shape and dimension;

a straight slit in an exterior surface of said second foam running along the length of said second foam;

a slot at least at one end of said second foam;

a fabric covering wrapped around said second foam, having opposing ends fitted into said slit and opposing sides tucked into said slot; and means for coupling said first and second foams at a predetermined angle with respect to one another;

wherein said means couples said first and second foams at a 90° angle with respect to one another; and wherein said means includes a corner elbow overlying respective ends of said foams at substantially 90° angles.

* * * * *